US007756453B2

(12) United States Patent
Yamazaki

(10) Patent No.: US 7,756,453 B2
(45) Date of Patent: Jul. 13, 2010

(54) COLOR PRINTING APPARATUS HAVING A TRANSFER BELT ATTACHING/DETACHING MECHANISM

(75) Inventor: Takahiro Yamazaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 830 days.

(21) Appl. No.: 11/560,032

(22) Filed: Nov. 15, 2006

(65) Prior Publication Data

US 2007/0116497 A1 May 24, 2007

(30) Foreign Application Priority Data

Nov. 22, 2005 (JP) ..... 2005-336965
Aug. 2, 2006 (JP) ..... 2006-211293

(51) Int. Cl.
*G03G 15/01* (2006.01)

(52) U.S. Cl. ..... 399/299; 399/302

(58) Field of Classification Search ..... 399/299, 399/302
See application file for complete search history.

(56) References Cited

U.S. PATENT DOCUMENTS 6,061,542 A * 5/2000 Minami et al. ..... 399/299
6,535,707 B2 3/2003 Maruta et al.
2005/0074259 A1* 4/2005 Tachiki et al. ..... 399/121
2005/0219602 A1* 10/2005 Mikami ..... 399/28

FOREIGN PATENT DOCUMENTS

| | | |
|---|---|---|
| JP | 03-288173 | 12/1991 |
| JP | 06-102776 | 4/1994 |
| JP | 3325071 | 7/2002 |
| JP | 2002-304036 | 10/2002 |
| JP | 2004-054062 | 2/2004 |
| JP | 2005-099732 | 4/2005 |
| JP | 2005-242170 | 9/2005 |

* cited by examiner

*Primary Examiner*—David M Gray
*Assistant Examiner*—Ryan D Walsh
(74) *Attorney, Agent, or Firm*—Oblon, Spivak, McClelland, Maier & Neustadt, L.L.P.

(57) ABSTRACT

A color printing apparatus having a plurality of photosensitive drums corresponding to each color, AND a transfer belt which is aligned with the plurality of photosensitive drums. An attaching/detaching mechanism which brings the transfer belt into and out of contact with the photosensitive drums, based on a number of black and white pages to be or which are printed.

16 Claims, 8 Drawing Sheets

COLOR PRINTING APPARATUS HAVING A TRANSFER BELT ATTACHING/DETACHING MECHANISM

CROSS-REFERENCE TO RELATED APPLICATION

This patent specification is related to and claims priority under 35 U.S.C. §119 to Japanese patent applications No. 2005-336965, filed on Nov. 22, 2005 and No. 2006-211293, filed on Aug. 2, 2006, in the Japanese Patent Office, the entire contents of each are incorporated herein by reference.

BACKGROUND OF THE INVENTION

1. Field of the Invention

This invention relates to printing. The invention further relates to minimizing an unnecessary contact between photosensitive drums and a transfer belt.

2. Discussion of the Background

A color printing apparatus having a plurality of photosensitive drums has formed thereon toner images of each color. The toner images of each color are transferred to a transfer belt, and subsequently transferred to a recording sheet from the transfer belt. The color printing apparatus having this type of structure is called a tandem type.

In the tandem type color printing apparatus, unnecessary contact between the photosensitive drums and the transfer belt can be avoided to reduce wear by detaching the transfer belt from the photosensitive drums based on a print mode. Typical printing devices of this type are disclosed, for instance, in Japanese Patent No. 3325071 and Japanese Open-Laid Patent H06-102776 and 2005-242170. In the color printing apparatus of this type, when the print mode changes from a black and white mode to a color mode and vice versa, time is needed to attach and detach the transfer belt and the photosensitive drum which causes a decline of productivity in printing.

SUMMARY OF THE INVENTION

In light of recognition of the above described problem by the present inventor, the invention provides a color printing apparatus having a transfer belt attaching/detaching mechanism. For example, the color printing apparatus includes a plurality of photosensitive drums corresponding to each color, a transfer belt, and a printing unit which can print with two modes, a single color mode and a multi color mode. An attaching/detaching mechanism attaches and detaches the transfer belt from the photosensitive drums. A controller controls the attaching/detaching mechanism based on a number of pages in the single color mode, when a print job contains both single color and multi-color pages.

BRIEF DESCRIPTION OF THE DRAWINGS

In order that the invention may be more clearly understood, it will now be disclosed in greater detail with reference to the accompanying drawings, wherein.

DESCRIPTION OF THE PREFERRED EMBODIMENTS

Figure 1:
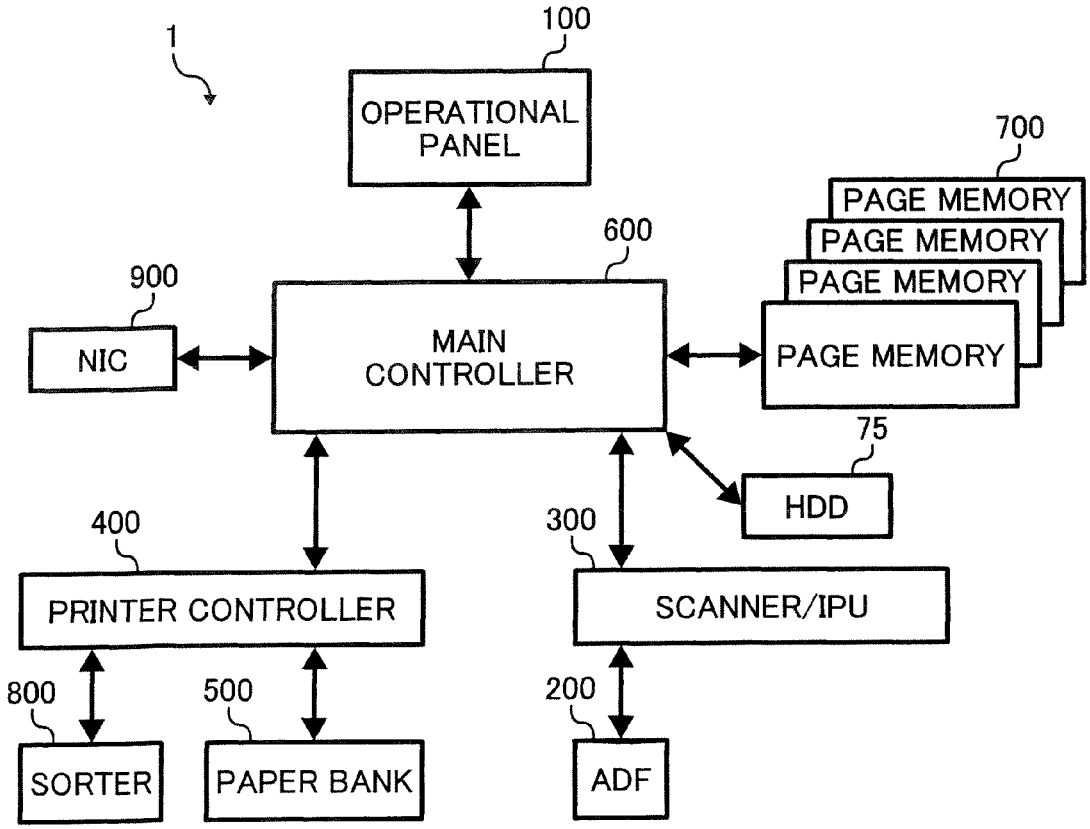
FIG. 1 is a block diagram illustrating a color printing apparatus of this invention.
Figure 2:
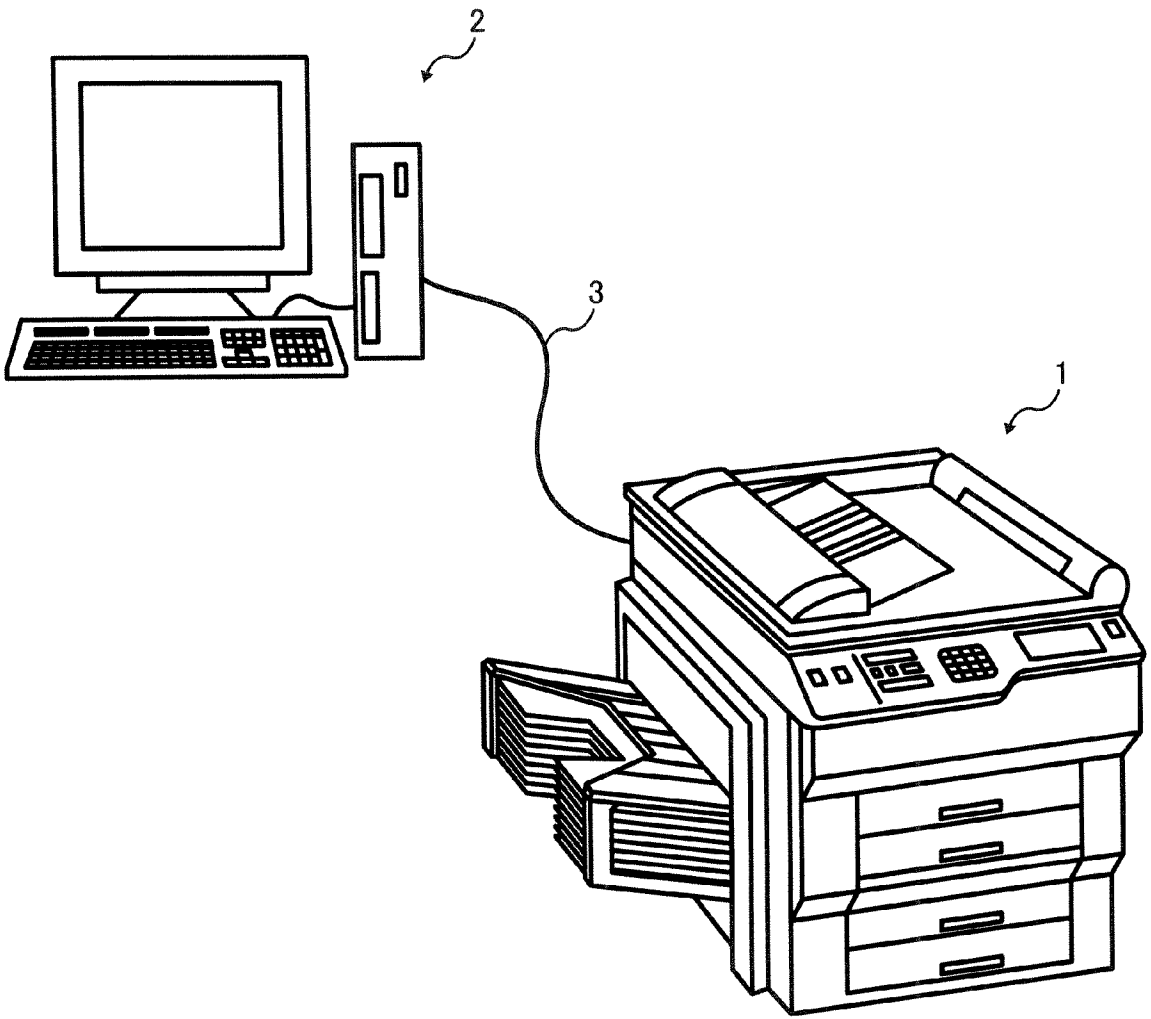
FIG. 2 is an illustration of a color printing apparatus and a personal computer.

FIG. 1 is a block diagram illustrating one embodiment of a color printing apparatus 1. In this embodiment, the color printing apparatus 1 is a so called a tandem type with a transfer belt, which transfers toner images on a photosensitive drums to a transfer belt in turn to form a color toner image on the transfer belt, and transfers the color toner image to a recording sheet. FIG. 2 is an aspect illustrating both the color printing apparatus 1 and a personal computer (PC) 2. Based on both FIG. 1 and FIG. 2, the color printing apparatus 1 is explained.

As illustrated in FIG. 1, the color printing apparatus 1 includes an operational panel 100 and a main controller 600. The operational panel 100 can have any desired structure or features such as a print start key, a ten key pad number keys, function setting keys, system setting keys, a liquid crystal display (LCD) touch panel for displaying the information to an operator, and/or any desired keyboard or display.

An automatic document feeder (ADF) 200 feeds an original to a contact glass at a predetermined timing and discharges the original after scanning. A scanner/image processing unit 300 scans the original on the contact glass by a light from a lamp, focuses a reflected light from the original to a charge coupled device (CCD) through a group of mirrors, a lens, and a filter, for example. The CCD converts the reflected light to an electrical signal. The electrical signal is amplified and converted to digitized data. The scanner/image processing unit 300 also has a pattern generator and outputs pattern data based on an instruction from a main controller 600. The digitized data is applied a shading process, a gamma correction in the scanner/image processing unit 300, for example.

The scanner/image processing unit 300 may perform an image magnification/reduction, or other processing or conversions based on instructions which may be received from the operational panel 100 or another source, and sent through the main controller 600. After image processing to the digitized data is performed, the digitized data is sent to the main controller at a predetermined timing.

The main controller 600 stores the digitized data from the scanner/image processing unit 300 to a page memory 700, which may be a dual inline memory module (DIMM), for example, although any memory, RAM, or disk may be used. Based on a data request from a printer controller 400, the main controller 600 retrieves the digitized data from the page memory 700 and sends the data to the printer controller 400. The main controller 600 may also store the digitized data to a hard disk drive (HDD) 750.

The printer controller 400 converts a density of the digitized data from the main controller 600 to have appropriate density characteristics for printing. The printer controller 400 forms latent images on photosensitive drums 6-1, 6-2, 6-3 and 6-4 (shown in FIG. 3) by scanning beams of laser diodes (LD) based on the converted digitized data. The latent images are developed into toner images and the toner images are transferred to a recording sheet. The toner image is fixed to the recording sheet by a fixing unit (shown in FIG. 3) and the recording sheet is discharged to a sorter 800. The printer controller 400 has a memory to store data for image forming conditions and fixing conditions.

The sorter 800 sorts the recording sheets discharged from the color printing apparatus 1 based on a sorting mode indicated through the operational panel 100. A paper bank, cassette, or tray 500 feeds the recording sheet at a predetermined time during the image forming operation.

A network interface controller (NIC) 900 interfaces the color printing apparatus 1 and the PC 2. The color printing apparatus 1 receives printing data and printing commands, e.g. a print mode, application data, etc., through the NIC 900. There are at least two print modes performed in the color printing apparatus 1; one is a black mode or black and white mode, also referred to as a single color mode, which uses only black toner (or another color toner) for image forming, and the other is a color mode which uses at least one more color and preferably uses all of the toner colors (e.g., a total of four colors of toner) for image forming. The application data shows the application which requests the print job. The main controller 600 stores the printing data to the memory 700 and the HDD 750 and waits for a data request from the printer controller 400. The main controller 600 also sends the print mode command to the printer controller 400 page by page. The print mode is indicated for every page and preferably indicates whether the printing is in a single color mode, or a multi color or full color mode.

FIG. 2 is a perspective view of the color printing apparatus 1 connected to the PC 2. The color printing apparatus 1 and the PC 2 are connected through a local area network (LAN) 3 and the PC 2 sends a print job to the color printing apparatus 1. The PC 2 can control the color printing apparatus 1 by sending the printing commands, which are set through settings in a printer driver installed in the PC 2, for example.

Figure 3:
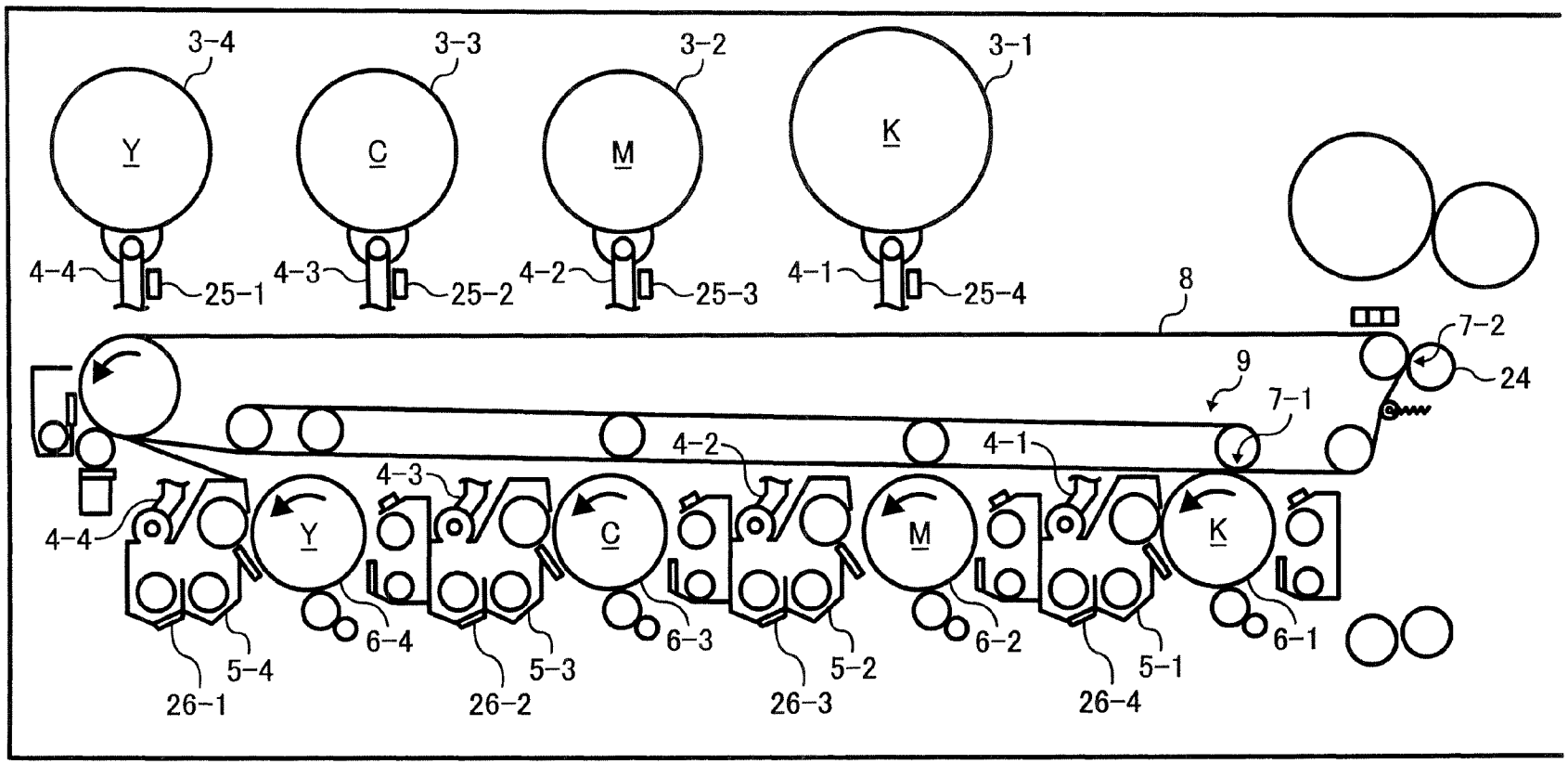
FIG. 3 illustrates the structure of a tandem type color printing apparatus.

FIG. 3 shows an image forming structure of the tandem type color printing apparatus 1. A toner cartridge 3-1 contains black toner and conveys the black toner to a developer 5-1 through a tube 4-1. In the toner cartridge 3-1 and the developer 5-1, toner detectors 25-1 and 26-1 are provided and detect toner in the toner cartridge 3-1 and the developer 5-1. If the toner in the toner cartridge 3-1 is empty but some toner remains in the developer 5-1, then it means the black toner is in a near empty status. If both the toner sensor 25-1 and 26-1 indicate empty, then it means the black toner is in an empty status. The developer 5-1 develops the latent image on the photosensitive drum 6-1 into a toner image and the toner image is transferred to a transfer belt 8 at a transfer point 7-1.

A toner cartridge 3-2, a tube 4-2, a developer 5-2, a photosensitive drum 6-2, and the toner detectors 25-2 and 26-2 are for magenta toner. A toner cartridge 3-3, a tube 4-3, a developer 5-3, a photosensitive drum 6-3, and toner detectors 25-3 and 26-3 are for cyan toner. A toner cartridge 3-4, a tube 4-4, a developer 5-4, a photosensitive drum 6-4, and toner detectors 25-4 and 26-4 are for yellow toner but work similarly as the image forming structure for the black toner. Each of the toner images is transferred to the transfer belt 8 and forms a color toner image.

The color toner image on the transfer belt 8 is transferred to the recording sheet from the sheet bank 500 at a second transfer point 7-2. An attaching/detaching mechanism 9 attaches or detaches the transfer belt 8 to/from the photosensitive drums 6-2, 6-3 and 6-4.

Figure 4A:
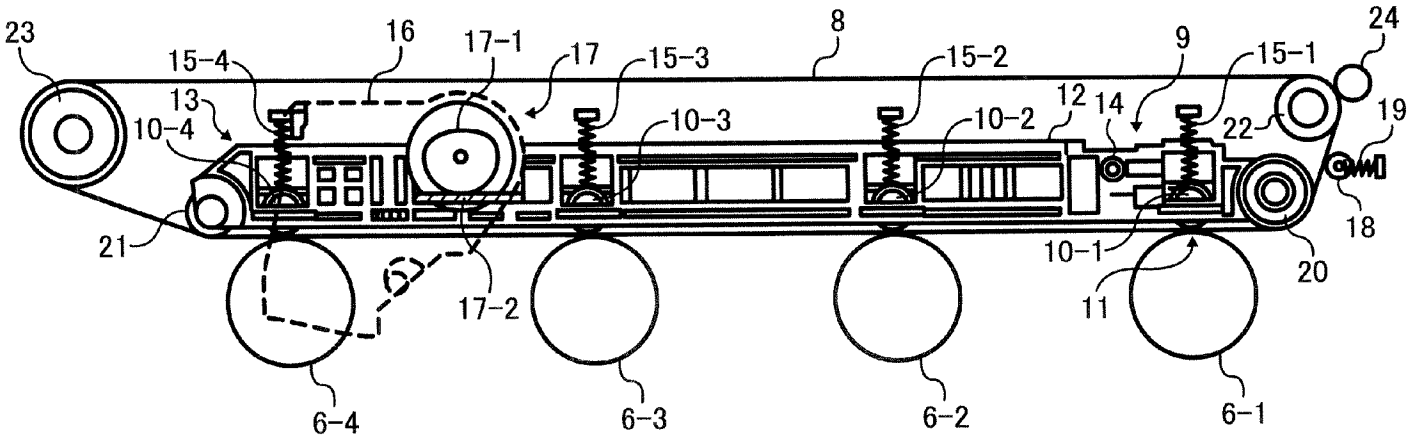
FIG. 4A illustrates the structure of an attaching/detaching mechanism, which is in an attached state.
Figure 4B:
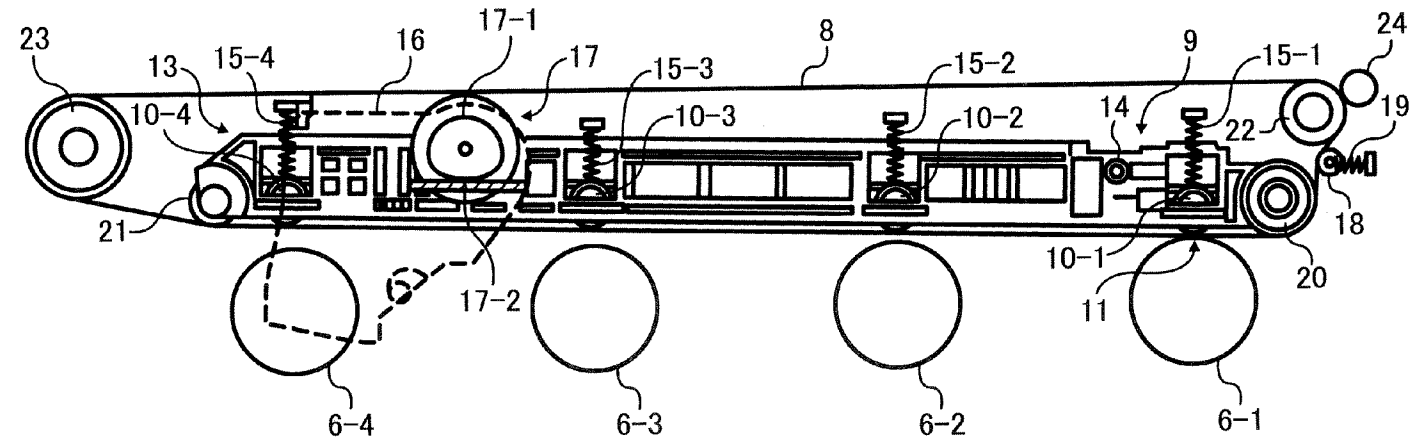
FIG. 4B illustrates the attaching/detaching mechanism of FIG. 4A in a detached state.

FIG. 4A shows the attaching/detaching mechanism 9 in an attached position, and FIG. 4B shows the attaching/detaching mechanism 9 is in a detached position. The attaching/detaching mechanism 9 is arranged in or near the transfer belt 8 and includes a contact roller 10-1 which contacts the photosensitive drum 6-1 at a contact point 11. The attaching/detaching mechanism 9 is also provided with contact rollers 10-2, 10-3 and 10-4 which contact photosensitive drums 6-2, 6-3 and 6-4. A frame 12 pivots around a rotation axis 14 powered by a rotation mechanism 13. The attaching/detaching mechanism 9 enables the transfer belt 8 to attach to or contact the photosensitive drums 6-2, 6-3 and 6-4 or to detach or separate from the photosensitive drums 6-2, 6-3 and 6-4.

The rotation mechanism 13 is provided with the rotation axis 14 which supports the frame 12 and connects the frame 12 to the color printing apparatus 1, springs 15-1, 15-2, 15-3 and 15-4 which provide forces to pull up the frame 12, a rotation motor 16 which is placed at an opposite side from the rotation axis 14, and a cam mechanism 17 which is attached to an axis of the rotation motor 16. Lower ends of the springs 15-1, 15-2, 15-3 and 15-4 are connected to the frame 12 while upper ends of the springs 15-1, 15-2, 15-3 and 15-4 are fixed to the color printing apparatus 1.

A cam mechanism 17 is provided with a cam 17-1, which has an asymmetric oval shape shown in FIG. 4A and FIG. 4B, and a base plate 17-2 which is fixed to the frame 12 and goes up and down by a movement of the cam 17-1. A roller 18 and a spring 19 work as a tension control mechanism. One end of the spring 19 is fixed to the color printing apparatus 1 and the other end of the spring 19 is fixed to the roller 18. This structure makes the roller 18 push the transfer belt 8 and keeps the tension of transfer belt 8 constant.

In this embodiment, the tension mechanism is explained as the roller 18 and the spring 19, but in another embodiment, for example, the mechanism can be the roller 18 and an arm which is attached to a rotation axis of the roller 18. This alternative structure enables a pivot movement of the roller 18, and a weight which attaches to the arm provides the tension control mechanism.

Rollers 20 and 21 which are supported by the frame 12, and rollers 22 and 23 which are supported by the color printing apparatus 1 support the transfer belt 8. A roller 24 which is pushed against the roller 22 and powered by a driving motor provides a rotating force for the transfer belt 8.

The rotation motor 16 rotates the cam 17-1 which causes the attaching/detaching mechanism 9 to pivot around the rotation axis 14. The pivoting movement of the attaching/detaching mechanism 9 makes the attaching/detaching mechanism 9 attach to or to detach from the photosensitive drums 6-2, 6-3, and 6-4.

In this embodiment, the cam mechanism 17 is adopted to make a pivotal movement for the attaching/detaching mechanism 9, but in other embodiments a motor and a rack-and-pinion gear or a solenoid could be adopted to push down to the attaching/detaching mechanism 9. As a further alternative, one or more air cylinders or hydraulic actuated devices may be used to move the mechanism 4. Moreover, a motor and gears may be utilized to move the mechanism 4.

When a cam surface having a longer radius of the cam 17-1 contacts the base plate 17-2, the frame 12 is pushed down. Therefore, the transfer belt 8 contacts the photosensitive drum 6-1, 6-2, 6-3 and 6-4, as shown in FIG. 4A.

When a cam surface having a shorter radius side contacts the base plate 17-2, the frame 12 is pulled up by the force of the springs 15-1, 15-2, 15-3 and 15-4. Therefore, the transfer belt 8 separates from the photosensitive drums 6-2, 6-3 and 6-4 as shown in FIG. 4B. But the photosensitive drum 6-1 which is for the black toner remains in contact with the transfer belt 8.

Figure 5:
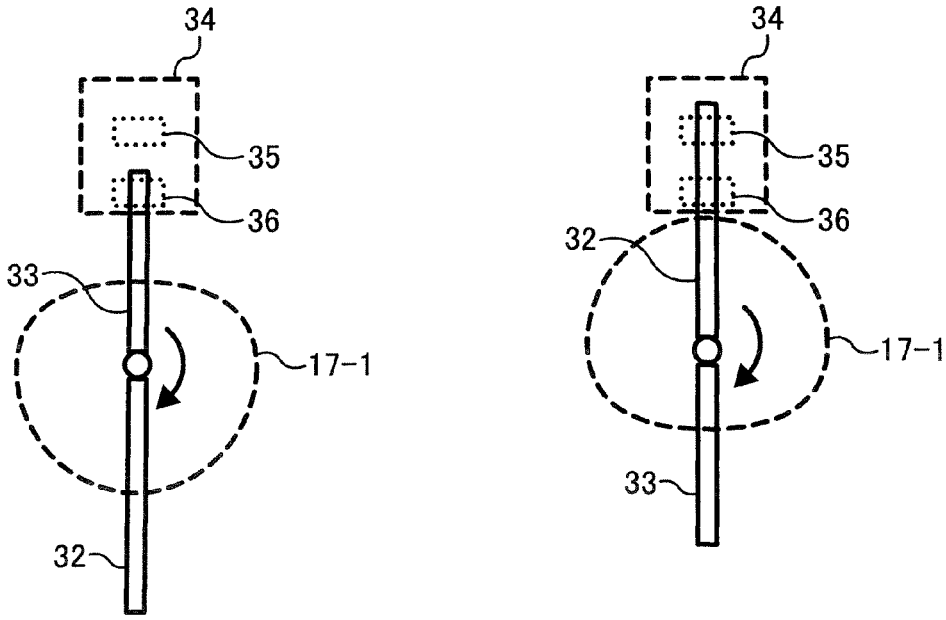
FIG. 5A illustrates a cam position detector in a first position.
FIG. 5B illustrates a composition detector in a second position.

FIGS. 5A and 5B show a structure of a cam position detector. The cam 17-1 is attached on one end of an axis and two members or rods 32, 33 which have different lengths are attached on the other end of the axis. A detector 34, which has two sensors 35 and 36, detects the members 32 and 33. The sensors 35 and 36 employ a transmissive detector, which is the type of detector with a photo diode and a detector facing each other has a target or member interrupt the beam path. The longer member 32 interrupts both sensors 35 and 36, but the shorter member 33 only interrupts the sensor 36. Accordingly, it is possible to judge a position of the cam 17-1, which means a position of the attaching/detaching mechanism 9, by judging output signals of the sensors 35 and 36.

When the both sensors 35 and 36 are interrupted (FIG. 5B), that means the attaching/detaching mechanism 9 is separated from the photosensitive drums 6-2, 6-3 and 6-4. On the other hand, when only the sensor 36 is interrupted, that means the attaching/detaching mechanism 9 is contacted to the photosensitive drum 6-2, 6-3 and 6-4. While one type of position sensor has been illustrated in FIGS. 5A and 5B, other types of sensors may be used, such as proximity or contact sensors.

Figure 6:
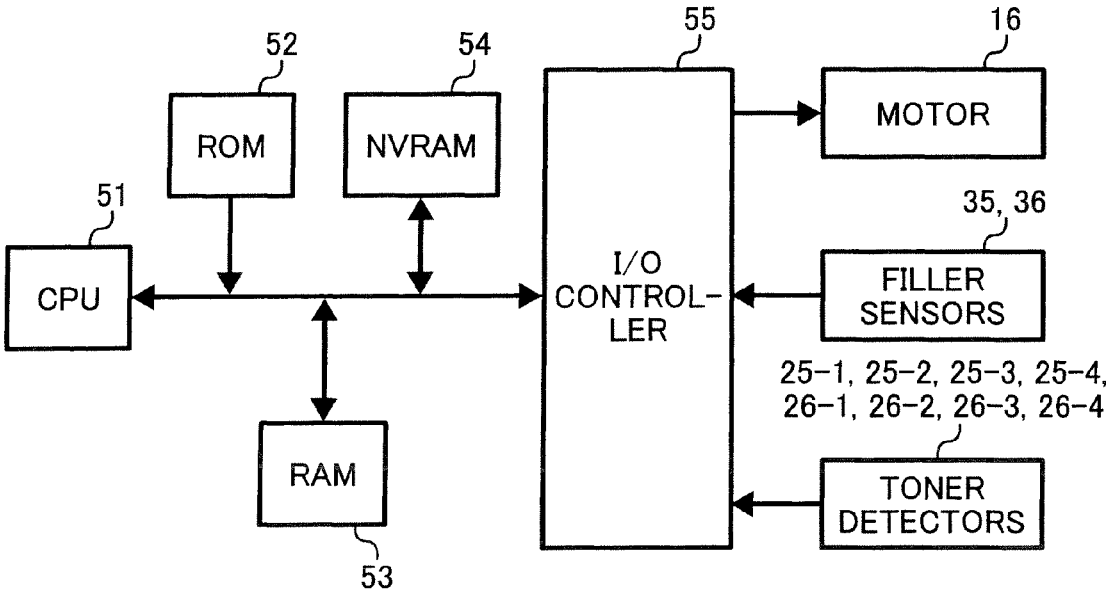
FIG. 6 is a block diagram illustrating a printer controller and electrical components of the printing apparatus.

FIG. 6 shows a block diagram of the printer controller 400. The printer controller 400 includes a CPU 51, a ROM 52 which stores a program for the attaching/detaching control of these inventions, a RAM 53 which is used as a work area for the CPU 51, and a NVRAM 54 which stores settings from the operational panel 100 or the PC2 through the printer driver setting. Further, an I/O controller 55 controls the rotation motor 16 based on detecting results from the sensors 35 and 36 also detects the output signals of the toner detectors 25-1, 25-2, 25-3, 25-4, 26-1, 26-2, 26-3 and 26-4.

Figure 7:
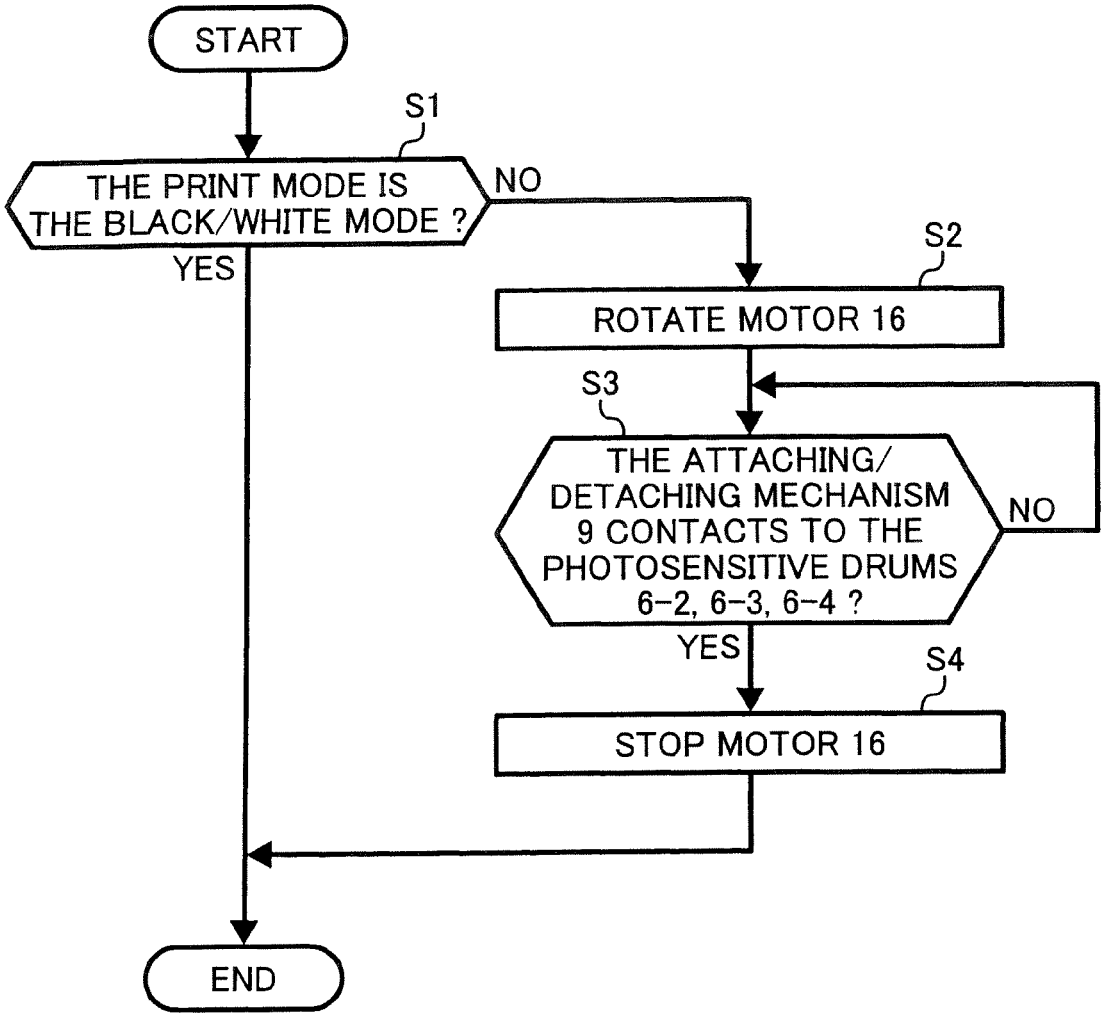
FIG. 7 is a flowchart of a process for bringing the belt into contact with the photosensitive drums.

FIG. 7 shows a flowchart of an attaching/detaching process of the transfer belt 8 in both the color mode and the black and white, or monocolor mode.

When the printing job is sent from the PC 2, the main controller 600 sends a printing request to the printer controller 400. The printer controller 400 judges whether the printing mode is the color mode or the black mode by the print mode command from the main controller 600 (S1). If the black mode is requested (S1/YES), then the printer controller 400 forms the image with only the photosensitive drum 6-1 and the process ends. However, if the color mode is requested, then the printer controller 400 uses the photosensitive drums 6-2, 6-3 and 6-4 in addition to the photosensitive drum 6-1 to form the image. In this case, the printer controller 400 controls the rotation motor 16 (S2) until the transfer belt 8 contacts the photosensitive drums 6-1, 6-2, 6-3 and 6-4. When the drums are detected to contact the transfer belt 8 in step S3, flow proceeds to step S4 which stops the motor 16.

Figure 8:
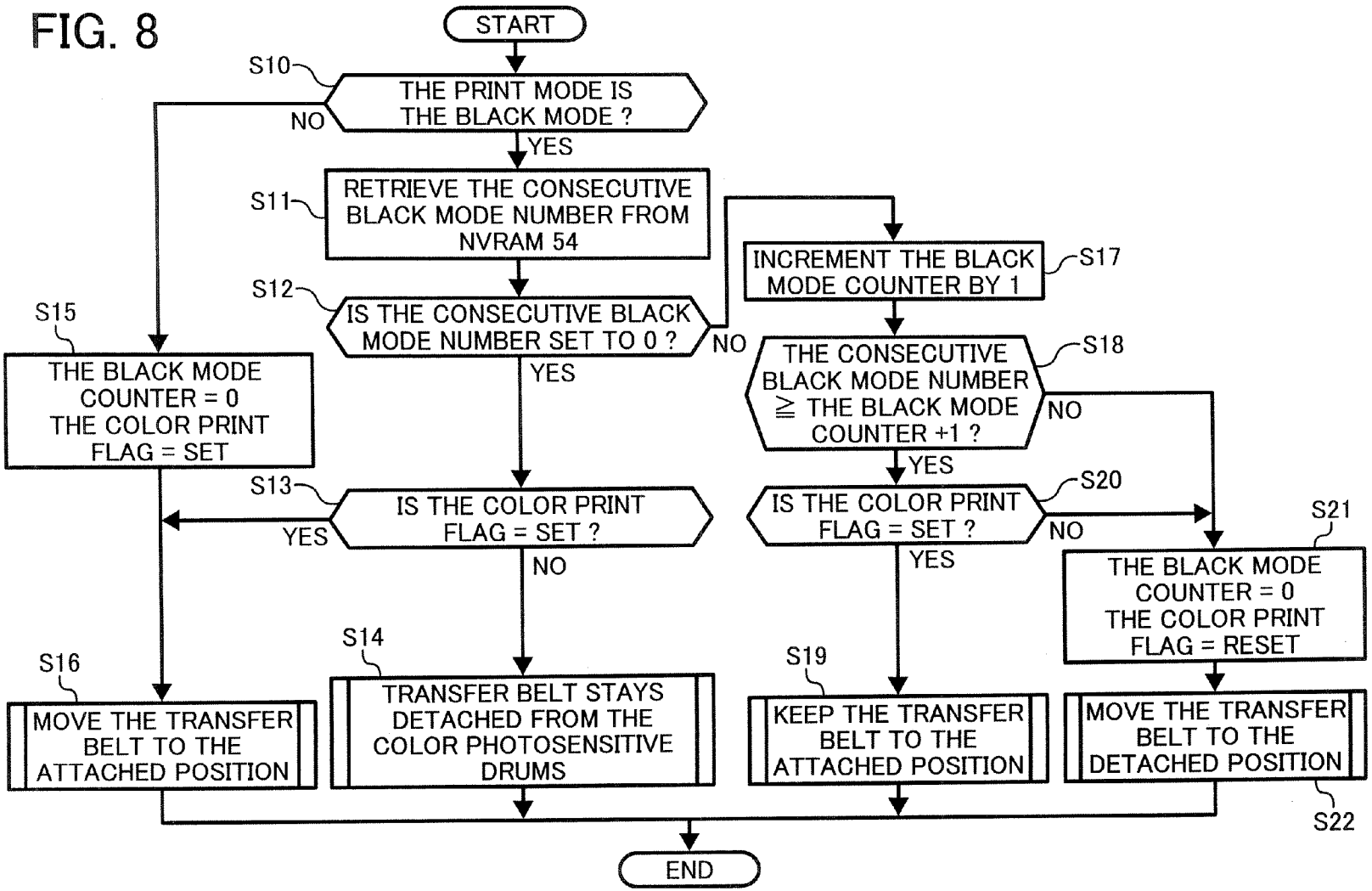
FIG. 8 is a flowchart of a first embodiment of a transfer belt attaching/detaching process.

FIG. 8 shows an example of the attaching/detaching process of the transfer belt 8.

In this embodiment, an explanation is provided using a consecutive black mode number, which is a number of pages printed in the black mode or monochrome mode which causes the attaching/detaching mechanism 9 to move from the attached position to the detached position. When the number of printed pages in the black mode is set to zero, the transfer belt 8 remains attached to the photosensitive drums 6-2, 6-3 and 6-4. As an alternate example, when the number of printed pages in the black mode is set to two, two black mode pages are printed with the transfer belt 8 in the attached position and after these two pages, the transfer belt 8 is moved from the attached position to the detached position, and subsequent black and white pages are printed when in the detached position.

Also, according to an example of the preferred embodiment when printing multi-page print jobs, there is used a color print flag which is set when the print in the color print mode is started, and a black mode counter which counts the number of printed pages in the black mode. As an alternative, such a flag is not used.

Case 1: print job which uses the black mode (also referred to as the black and white mode or the monochrome mode), and the consecutive black mode number is zero.

The printer controller 400 judges the print mode by the print mode command from the main controller 600 (S10). If the print mode is the black mode (S10/YES), flow proceeds to step S11 which retrieves the consecutive black mode number from the NVRAM 54 (S11) which as stated above is zero for this case. Consequently, step S12 determines that the consecutive black mode number is set to zero and flow proceeds to step S13. In step S13, the printer controller 400 judges whether the color print flag is set, indicating whether the printer has printed in a color mode. If the printer is not in the color mode (S13/NO), then the transfer belt 8 of the attaching/detaching mechanism 9 stays in the detached position such that the photosensitive drums 6-2, 6-3, and 6-4 do not contact the transfer belt 8 (S14) and printing continues, as needed.

Case 2: print job which uses the color mode and the consecutive black mode number is zero.

The printer controller 400 judges the print mode by the print mode command from the main controller 600 (S10). In this case, the print mode is the color mode (S10/NO) and flow proceeds to step S15 in which the printer controller 400 sets the color print flag on and the black mode counter is set to zero. Step S16 then moves the transfer belt 8 to the attached position such that the belt 8 contacts each of the photosensitive drums 6-1, 6-2, 6-3, and 6-4.

Case 3-1: print job with a mixed mode, meaning the print job is done partly in the black mode and partly in the color mode, and the consecutive black mode number is zero.

In this example, the print mode changes from (1) the black mode to (2) the color mode and to (3) the black mode again.

The printer controller 400 judges the print mode by the print mode command from the main controller 600 (S10). First, the print mode is the black mode and the process explained above for case 1 is performed. Second, the color mode is used and the procedure for case 2 is performed.

Third, the black mode is used again and the printer controller 400 judges the print mode by the print mode command from the main controller 600 (S10). The print mode is the black mode (S10/YES) so flow proceeds to step S11 which retrieves the consecutive black mode number from the NVRAM. Step S12 is then performed as explained with respect to case 1. The consecutive black mode number is determined to be set to zero and flow proceeds to step S13. In step S13, the printer controller 400 judges whether or not the print job is in the color mode from the color print flag. In this case, the print job in the color mode is already started (S13/YES) and flow proceeds to step S16 in which the transfer belt 8 remains (or is moved to) the attached position and the print job continues.

Case 3-2: print job with a mixed mode and the consecutive black mode number is two.

In this explanation, the print mode changes from the color mode to printing three pages in the black mode.

First, when the color mode is required, the procedure explained for case 2 is performed (S15, S16). Second, the black mode is required and the procedure of case 1 is performed (S10, S11). In this case, the consecutive black mode number is set to two, so the result of step S12 becomes "No" and flow proceeds to step S17. In step S17, the black mode counter is incremented by one and flow proceeds to step S18. In step S18, the printer controller 400 compares the value of the black mode counter and the consecutive black mode number to determine if the consecutive black mode number is greater than or equal to the black mode counter plus one. In this case, the value of the black mode counter is less than the consecutive black mode number and the answer to step S18 is yes and flow proceeds to step S20. In step S20, the color print flag is determined to be set, and flow proceeds to step S19 in which the transfer belt 8 is kept in the attached position, even when the printer is in the black mode.

Third, for the next page in the black mode, the procedure explained above is performed (S12, S17, S18, S20, S19) and the black mode counter becomes two. For the next page in the black mode, the procedure explained above is performed (S12, S17) and the black counter becomes three. Accordingly, in step S18, the value of the black counter is greater than the consecutive black mode number (S18/NO), so flow proceeds to step S21. In step S21, the printer controller 400 sets the value of the black mode counter to zero, the color print flag is reset, and flow proceeds to step S22. In step S22, the transfer belt 8 is moved to the detached position and the print job continues to print.

According to an example of the invention, the main controller 600 sends the application data along with the printing request. The printer controller 400 stores the consecutive black mode number for each application separately in the NVRAM 54. Therefore in step S11 shown in FIG. 8, the printer controller 400 retrieves the consecutive black mode number based on the application. This feature allows an operator to select which priority is important; faster printing or durability/longevity. For example, a file which is produced by an application for providing presentations (e.g. PowerPoint), usually contains many color images and almost no plain text pages. In this case, the consecutive black mode number is set to zero to maintain productivity. To the contrary, a file which is produced by a text editor (e.g., Microsoft Word), usually contains many plain black and white text pages. In this case, the consecutive black mode number is set to relatively low number, e.g. one or two, and changes the position of the transfer belt 8 frequently to get longer lives of the transfer belt 8 and the photosensitive drums 6-1, 6-2, 6-3 and 6-4. The consecutive black mode number for each application can be set through the operational panel 100 or through a printer driver, for example.

Figure 9:
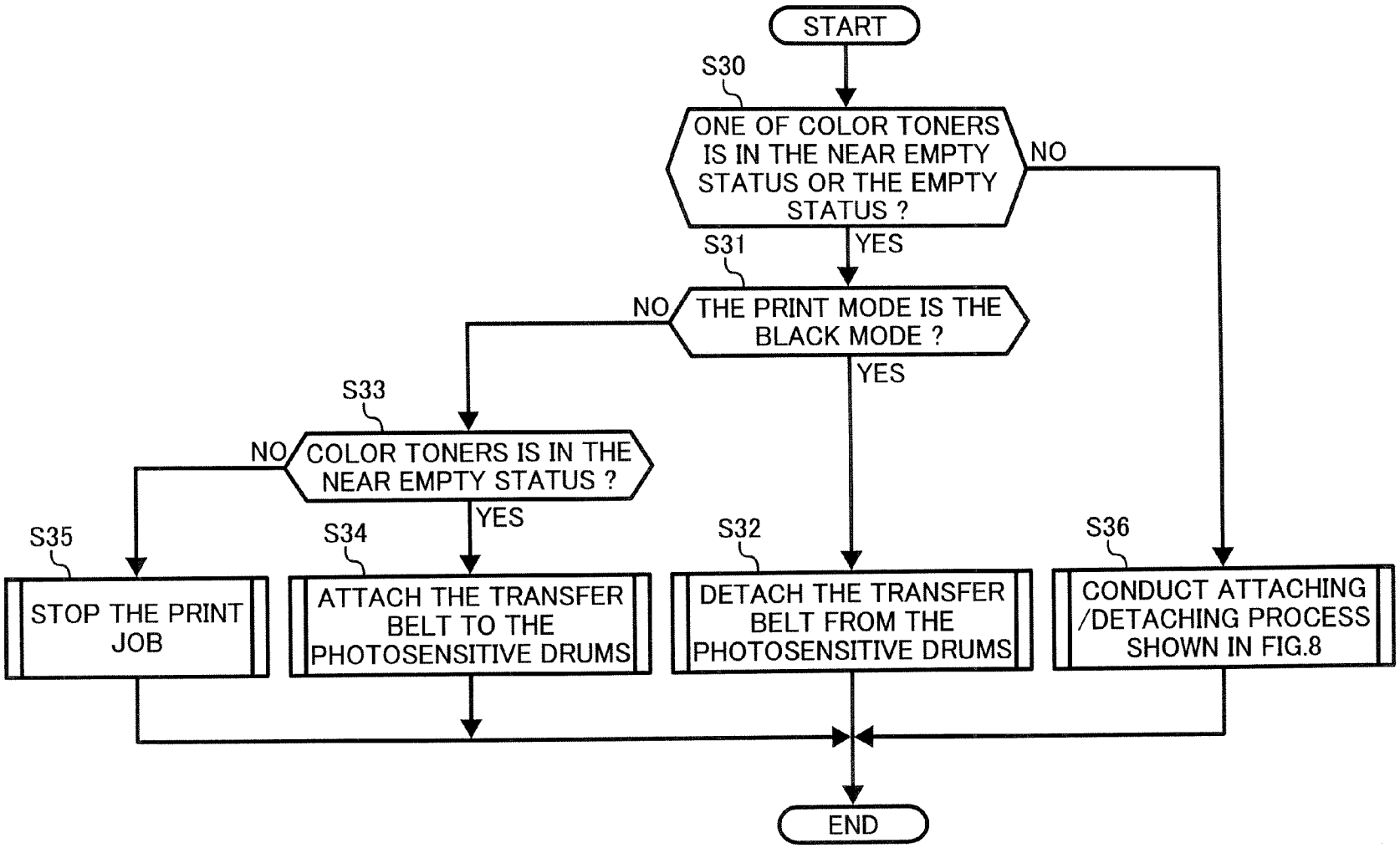
FIG. 9 is a flowchart of a second embodiment of a transfer belt attaching/detaching process.

FIG. 9 shows another example of the attaching/detaching process of the transfer belt 8 of this invention.

After starting, in step S30 the printer controller 400 judges a remaining amount of color toners (yellow, cyan, magenta) by the toner detectors 25-2, 25-3, 25-4, 26-2, 26-3 and 26-4. If the color toners are neither in the near empty status nor in the empty status (S30/No), then flow proceeds to step S36 and the attaching/detaching process shown in FIG. 8 is performed. If at least one of the color toners is in a near empty status or in the empty status, then the printer controller 400 determines whether the print mode is the black mode, for example by the print mode command in step S31. If the print mode is the black mode (S31/YES), then the printer controller 400 controls the rotation motor 16 to detach the transfer belt 8 from the photosensitive drums 6-2, 6-3 and 6-4, and the print job continues (S32). If the print mode is the color mode (S31/NO), then the printer controller 400 continues to judge the remaining amount of the toners during the print job in step S33. If the color toner is not empty, then the printer controller 400 controls the rotation motor 16 and attaches the transfer belt 8 to the photosensitive drum 6-2, 6-3 and 6-4 and the print job continues (S34). If one of the toners is in the empty status, then printing job is stopped (S35).

In case one of the color toners is in the empty status, the invention may be set to only allow black and white print jobs and avoids unnecessary contact between the transfer belt 8 and the photosensitive drums 6-2, 6-3 and 6-4.

In the above embodiment, the color printing apparatus 1 is explained as the tandem type but these inventions are applicable to a direct transfer type color printing apparatus, which transfers the toner images from the photosensitive drums 6-1, 6-2, 6-3 and 6-4 to the recording sheet. In the direct transfer type, a contact between the photosensitive drum 6-2, 6-3 and 6-4, and a sheet transfer belt is controlled.

While the invention may utilize a print mode signal to indicate whether a print mode signal to indicate whether a print job or a page of a print job is a color page/job or black and white, the invention may be implemented without such a mode signal. For example, the printer may determine based on the print data received whether a page or job is a color page/job, or a black and white page/job. Such a determination can be readily made by analyzing whether the received image data from the computer contains color image data.

As an alternative to moving the belt out of contact with the photosensitive drums, the photosensitive drums may be moved out of contact from the belt.

The present invention may be implemented using hardware, software/programmed processor, or a combination of both.

Obviously, numerous modifications and variations of the present invention are possible in light of the above teachings. It is therefore to be understood that within the scope of the appended claims, the invention may be practiced otherwise than as specifically described herein.

What is claimed is:

1. A color printing apparatus, comprising:

a plurality of photosensitive drums corresponding to a respective color;

a transfer belt which is aligned with the plurality of photosensitive drums;

a printing unit which prints using at least two modes, one being a single color mode and another being a multi-color mode;

an attaching/detaching mechanism which attaches the transfer belt to the photosensitive drums used in the multi-color in an attached position and detaches the transfer belt from the photosensitive drums which are used only in the multi-color mode in a detached position; and a controller which controls the attaching/detaching mechanism based on a number of consecutive pages in the single color mode when a corresponding job includes both the single color mode and the multi-color mode such that the attaching/detaching mechanism is in the detached position during the single color mode when the number of pages in the single color mode is at least one of greater than or equal to a predetermined number of consecutive single color mode pages, and the attaching/detaching mechanism is in the attached position during the single color mode when the number of pages in the single color mode is less than the predetermined number of consecutive single color mode pages.

2. A color printing apparatus according to claim 1, further comprising:

a number setting unit which sets the predetermined number of consecutive single color mode pages.

3. A color printing apparatus according to claim 2, further comprising:

an application setting unit which sets an application, wherein the controller stores the number of consecutive single color mode pages associate with the application.

4. A color printing apparatus according to claim 1, wherein the attaching detaching mechanism comprises:

a frame which pivotally moves around an rotation axis proximate to the photosensitive drum used in the single color mode; and a rotation mechanism which causes the pivotal movement of the frame.

5. A color printing apparatus according to claim 4, wherein the rotation mechanism comprises:

a base plate which is attached to the frame;

a cam which has an asymmetric oval shape and contacts the base plate;

a motor which rotates the cam; and a position detector which detects a position of the cam.

6. A color printing apparatus according to claim 1, further comprising:

toner empty detectors which detect toner empty states;

wherein the controller controls the attaching/detaching mechanism to be in the detached position when one of the color toners is detected to be in the toner empty state and allows printing using a single color mode.

7. A method, comprising:

printing, using a printing device, a color image using a plurality of colors of toner while a belt is urged towards photoconductive drums respectively corresponding to the colors of toner;

printing, using the printing device, an image using a single color of the plurality of colors of toner, while the belt is urged towards each of the photoconductive drums when a number of pages in a single color mode is less than a predetermined number of consecutive single color mode pages; and printing, using the printing device, an image using the single color toner, while the belt is urged towards only one of the photoconductive drums.

8. A method according to claim 7, further comprising:

separating the belt from each of the plurality of photoconductive drums, except for the photoconductive drum corresponding to the single color toner, after the printing using the single color toner while the belt is urged towards the photoconductive drums.

9. A method according to claim 7, further comprising:

counting a number of pages printed using the single color toner while the belt is urged towards the photoconductive drums, wherein the separating is performed after a counted number of pages is at least one of greater than or equal to the predetermined number of consecutive single color mode pages.

10. A method according to claim 8, wherein:

the printer includes a frame supporting the belt, and the frame pivots during the separating to separate the belt from each of the plurality of photoconductive drums, except for the photoconductive drum corresponding to the single color toner.

11. A method according to claim 6, further comprising:

detecting that at least one of the plurality of colors of toner is empty, wherein the separating is performed when the at least one of the plurality of colors is detected to be empty and the single color toner is not empty.

12. A printing apparatus comprising:

means for printing a color image using a plurality of colors of toner while a belt is urged towards photoconductive drums respectively corresponding to the colors of toner;

means for printing an image using a single color of the plurality of colors of toner, while the belt is urged towards each of the photoconductive drums, when the number of pages in the single color mode is less than a predetermined number of consecutive single color mode pages; and means for printing an image using the single color toner, while the belt is urged towards only one of the photoconductive drums.

13. A method according to claim 12, further comprising:

means for separating the belt from each of the plurality of photoconductive drums, except for the photoconductive drum corresponding to the single color toner, after the means for printing using the single color toner prints while the belt is urged towards the photoconductive drums.

14. A printing apparatus according to claim 12, further comprising:

means for counting a number of pages printed using the single color toner while the belt is urged towards the photoconductive drums, wherein the means for separating operates after a counted number of pages is at least one of greater than or equal to the predetermined number of consecutive single color mode pages.

15. A printing apparatus according to claim 13, wherein:

the printing apparatus includes a frame supporting the belt, and the frame pivots during the separating to separate the belt from each of the plurality of photoconductive drums, except for the photoconductive drum corresponding to the single color toner.

16. A printing apparatus according to claim 13, further comprising:

means for detecting that at least one of the plurality of colors of toner is empty, wherein the separating is performed when the at least one of the plurality of colors is detected to be empty and the single color toner is not empty.

* * * * *